United States Patent [19]

Ooka et al.

[11] 4,320,303

[45] Mar. 16, 1982

[54] SYSTEM FOR GENERATION OF ELECTRICITY BY UTILIZATION OF HEAT EXCHANGE BETWEEN LIQUEFIED NATURAL GAS AND INTERMEDIATE HEAT MEDIUM

[75] Inventors: Isami Ooka; Yosinori Hisazumi, both of Osaka, Japan

[73] Assignee: Osaka Gas Company, Ltd., Osaka, Japan

[21] Appl. No.: 196,964

[22] Filed: Oct. 14, 1980

[30] Foreign Application Priority Data

Oct. 11, 1979 [JP] Japan ..... 54-131371

[51] Int. Cl.[3] ..... F28D 7/10

[52] U.S. Cl. ..... 290/1 R; 165/104.25

[58] Field of Search ..... 60/641 B, 641.7; 62/467, 87, 88; 165/104.25; 290/1 R

[56] References Cited

U.S. PATENT DOCUMENTS 4,030,301 6/1977 Anderson ..... 60/641

*Primary Examiner*—J. V. Truhe

*Assistant Examiner*—Shelley Wade

*Attorney, Agent, or Firm*—Jones, Tullar & Cooper

[57] ABSTRACT

A system for generation of electricity which comprises warming an intermediate heat exchange medium, cooled and liquefied as the result of having been used for warming LNG to vaporize, with water or sea water to vaporize, introducing the vaporized intermediate heat medium into a turbine equipped with an electric power generator for driving and using again the intermediate heat medium discharged from the turbine for warming LNG to vaporize while the intermediate heat medium discharged from the turbine is contacted with the condensed liquid of the intermediate heat medium with intervention of a packing material.

2 Claims, 3 Drawing Figures

SYSTEM FOR GENERATION OF ELECTRICITY BY UTILIZATION OF HEAT EXCHANGE BETWEEN LIQUEFIED NATURAL GAS AND INTERMEDIATE HEAT MEDIUM

The present invention is a system for generation of electricity by utilization of heat exchange between liquefied natural gas (LNG) and an intermediate heat exchange medium. More particularly, it relates to a system for generation of electricity by efficient utilization of an intermediate heat exchange medium used for warming of LNG.

LNG is generally kept at a low temperature of about −160° C. during its storage and transportation. For use as fuel for electric power generation, town gas or the like, LNG is warmed, usually with water, or sea water to make natural gas (NG). In order to accomplish the efficient vaporization of LNG by warming with water or sea water, there have been made various proposals, among which typical ones are disclosed in Japanese Patent Publication (unexamined) Nos. 136413/1979 and 136414/1979. In these Japanese Patent Publications, LNG is first warmed with an intermediate heat exchange medium (e.g. propane, ammonia, dichlorodifluoromethane) to a temperature of about −20° to −50° C. for vaporization and then further warmed with water or sea water to a temperature above 0° C. so as to supply to any source for use, while the water or sea water used as above is employed for warming the intermediate heat exchange medium. In such system, the intermediate heat exchange medium is cooled with LNG to liquefy the medium and the liquefied medium is warmed with water or sea water to vaporize the medium. These conversions are repeated circularly. The efficient utilization of the heat energy during such circulation is of great significance from the viewpoint of saving energy.

As the result of an extensive study, there has now been developed a novel system for generation of electricity with a high efficiency by utilization of an intermediate heat exchange medium used for warming of LNG.

The electricity generation system of the present invention comprises warming an intermediate heat exchange medium, cooled and liquefied as the result of having been used for warming LNG to vaporize it, with water or sea water to vaporize the medium, introducing the vaporized intermediate heat exchange medium into a turbine adapted to drive an electric power generator and then using the intermediate heat exchange medium discharged from the turbine for warming LNG to vaporize it, these operations being effected repeatedly and circularly. In such a system, it is particularly favorable to contact the condensed liquid intermediate heat exchange medium with the intermediate heat exchange medium discharged from the turbine with intervention of a packing material, to prevent super-cooling of the intermediate heat exchange medium by LNG.

Figure 1:
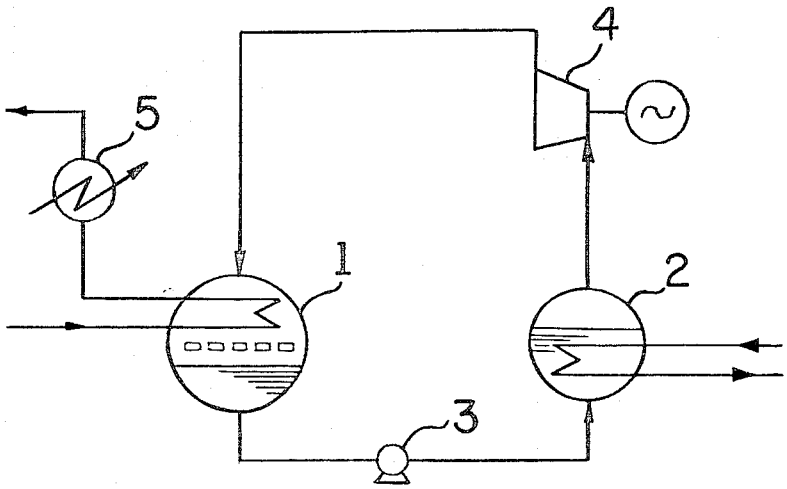
Figure 2:
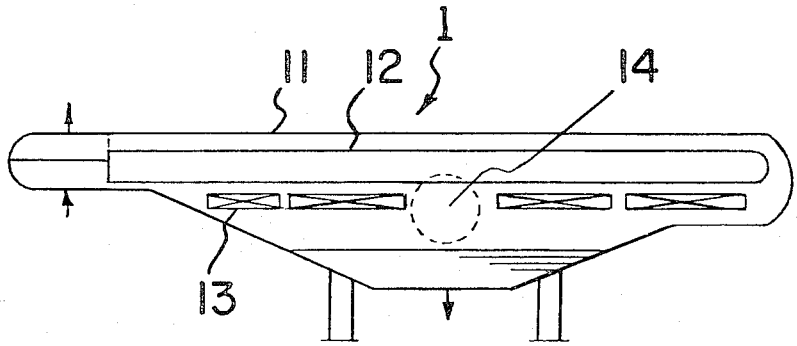
Figure 3:
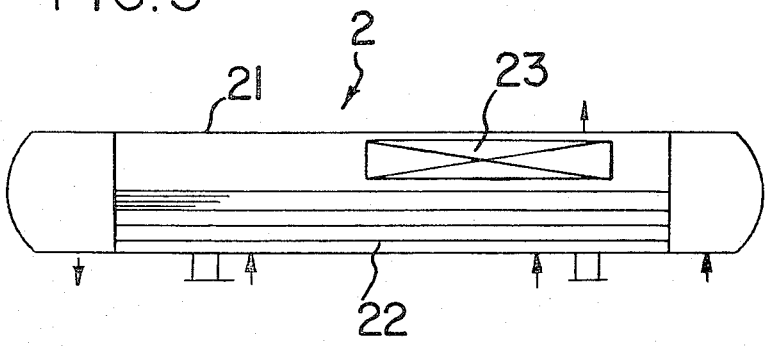

The present invention will be hereinafter explained with reference to the accompanying drawing wherein FIG. 1 is a flow sheet showing an embodiment of the electricity generation system of the invention, FIG. 2 is a simplified sectional view of the LNG vaporizer in the said system and FIG. 3 is a simplified sectional view of the liquefied propane gas (LPG) evaporator in the said system.

In FIG. 1, 1 shows a heat exchange means (i.e. LNG vaporizer) between LNG and propane as an intermediate heat exchange medium. As shown in FIG. 2, the heat exchange means may be constituted as a U-tube heat exchanger wherein the tube bundle 12 in the shell 11 is disposed on the upper half part, and LNG is introduced in the tube. The lower half part of the shell 11 is formed as a reservoir section for LPG. In the middle part, there is disposed an ordinary packing material (e.g. a mesh wire) 13. On the shell 11 corresponding to said middle part, there is provided an opening 14 for introduction of propane gas (PG).

2 shows a heat exchange means (i.e. LPG evaporator) between LPG and water or sea water. As shown in FIG. 3, the heat exchange means may be constituted as a fixed tube plate heat exchanger. The tube bundle 22 in the shell 21 is disposed on the lower half part, and either water or sea water is introduced into the tube. The PG formed by vaporizing LPG in the lower half part of the shell 21 is collected at the upper half part and taken out of the shell through a demister 23 for eliminating mist.

3 is a pump for pressure-feeding LPG at the bottom of the shell of the vaporizer 1 to the bottom of the shell of the evaporator 2. 4 is a turbine equipped with an electric power generator such as an axial flow reaction type gas turbine to be driven by PG from the evaporator 2. 5 is an after-heater for further heating the NG from the vaporizer 1 so as to supply to the consumer. The water or sea water once fed to the after-heater 5 may be utilized as a heat source for the evaporator 2.

In the system of the invention having the above construction, for instance, LNG (60 t/h, 33 kg/cm$^2$G, −150° C.) is introduced into the tube of the vaporizer 1, warmed and vaporized (at −50° C.) by the PG in the shell, and then taken out from the system. On the other hand, the PG in the shell of the vaporizer 1 is cooled and liquefied, and then pressurized to 7.5 kg/cm$^2$G by the pump 3 and supplied into the shell of the evaporator 2 (82.5 t/h), wherein the LPG is warmed and vaporized by water or sea water in the pipe (3000 t/h, 26° C.), and the produced PG is introduced into the turbine 4 (7.2 kg/cm$^2$G, 18° C.). The resulting output by the electric power generator is 1450 KW. The PG discharged from the turbine (0.02 kg/cm$^2$G, −42° C.) is introduced through the opening 14 into the shell of the vaporizer 1, wherein it is brought into contact with the condensed liquid drops of PG at the packing material 13 to maintain the temperature of the LPG in the shell at a level for nearly saturating the pressure in the shell (about −44° C. under the operating pressure of 1 atm). The said LPG is again fed to the evaporator 2 by means of the pump 3.

When the vaporizer 1 is not provided with a packing material 13, the condensed liquid of PG in the vaporizer is super-cooled to a temperature of about −50° C. As the result, the amount of circulation of LPG by the pump 3 may be lowered to about 80 t/h, and the evaporating pressure in the evaporator 2 may be lowered to about 7.0 kg/cm$^2$G, whereby the output of the generator becomes about 1400 KW.

As understood from the above, the system of the invention can achieve the generation of electricity with a high efficiency by utilizing effectively the cycle of liquefaction-vaporization of the intermediate heat medium.

What is claimed is:

1. A system for generation of electricity which comprises warming an intermediate heat exchange medium, cooled and liquefied as the result of having been used for warming LNG to vaporize the LNG with water or sea water to vaporize the medium, introducing the vaporized intermediate heat exchange medium into a turbine equipped with an electric power generator thereby driving the generator and then using the intermediate heat exchange medium discharged from the turbine to warm LNG to vaporize it while the intermediate heat exchange medium discharged from the turbine is contacted with condensed liquid intermediate heat exchange medium in contact with a packing material.

2. The system according to claim 1, wherein the heat exchange between the liquefied natural gas and the intermediate heat exchange medium is effected employing a U-tube heat exchanger which comprises a shell having in its upper half part a tube bundle, through which the liquefied natural gas flows, and in its lower half part a reservoir section for the liquefied intermediate heat exchange medium, with a packing material and an inlet for the intermediate heat exchange medium from the turbine into the shell located between the tube bundle and the reservoir heat exchange between the intermediate heat exchange medium and the water or sea water being effected by the use of a fixed tube plate heat exchanger with a tube bundle, through which the water or sea water flows, provided in the lower half of the shell.

* * * * *